United States Patent [19]

Slaughter

[11] 3,938,723

[45] Feb. 17, 1976

[54] METHOD FOR ROLLING THIN METAL FILMS

[76] Inventor: Edward R. Slaughter, 7938 Brentwood Road, Mentor, Ohio 44060

[22] Filed: Jan. 3, 1972

[21] Appl. No.: 215,044

[52] U.S. Cl. ..... 228/117; 228/159; 228/163; 228/191

[51] Int. Cl.[2] ..... B23K 21/00

[58] Field of Search ..... 29/471.1, 472.3, 475, 480, 29/481, 470.9; 228/117, 159, 163, 190, 191

[56] References Cited

UNITED STATES PATENTS

| | | | |
|---|---|---|---|
| 2,366,168 | 1/1945 | Bakarian | 29/475 |
| 3,052,964 | 9/1962 | Heuer | 29/470.9 UX |
| 3,380,146 | 4/1968 | Babel et al. | 29/470.9 X |
| 3,623,197 | 11/1971 | Jones | 29/481 X |

FOREIGN PATENTS OR APPLICATIONS

| | | | |
|---|---|---|---|
| 836,812 | 6/1960 | United Kingdom | 29/423 UX |

*Primary Examiner*—Richard Bernard Lazarus
*Attorney, Agent, or Firm*—Fay & Sharpe

[57] ABSTRACT

The specification and drawings disclose a method and apparatus for rolling plural metal strips simultaneously to form thinner metal strip or foil. The method allows use of larger diameter rolls and simpler roll supporting structure and mill controls than heretofore possible in foil forming. The disclosed method contemplates the provision of a plurality of metal strips which are then bonded together in juxtaposed relationship with a thin layer of matrix material which substantially completely covers the opposed faces of the strips to form a composite comprising alternate layers of metal strip and matrix material. Thereafter the composite is rolled to reduce the strips to the desired thickness. Subsequently, the bond between the strips is destroyed and the strips are separated. According to certain embodiments, strong or low ductility metals can be formed into foils by bonding them in the central portion of the composite. Weaker or more ductile metals form the outer portions of the composite. Apparatus capable of carrying out the method is also disclosed.

5 Claims, 5 Drawing Figures

METHOD FOR ROLLING THIN METAL FILMS

BACKGROUND OF THE INVENTION

The subject invention is directed toward the art of metal forming and, more particularly, to an improved foil forming method and apparatus.

The invention is especially suited for forming very thin metal strips or foils and will be described with particular reference thereto; however, as will be appreciated, the invention is capable of broader application and could be used for forming strips or sheets of a range of thicknesses.

As used in the subject specification and claims, the term "strip" is used to identify the thicker input material to the rolling process and the term "foil" is used to identify the thinner output or product. Typically, the term foil is limited to material of less than 6 mils in thickness. And, although the invention is particularly suited for forming metals to a thickness of less than 6 mils, as used in the subject specification and claims foil is also intended to encompass an output or product which can have a thickness somewhat greater than 6 mils.

In the past, thin metal strip or foil has been formed by passing a single metal strip through a series of roll gaps of decreasing spacing. As is well known, the diameter of the rolls forming the roll gap must be related to strip thickness in order for a reduction in thickness to be effected during rolling. That is, as the strip thickness is reduced, the diameters of the rolls forming the roll gap must be reduced.

Within limits, the noted approach works satisfactorily. However, as the thickness decreases, problems are encountered in maintaining a uniform thickness across the width of the strip. This is primarily because the small diameter rolls required for the final reductions lack mechanical stability (e.g. beam strength) and deflect along their length under load. Various types of backup rolls, complicated roll deflecting systems and the like have been used in an attempt to overcome the problem.

The productivity of a rolling mill is inversely related to the strip thickness and the precision and complexity of the rolling mill required increases as the strip thickness decreases. As the strip approaches foil gauges during rolling, the decreased productivity and the increased complexity of the rolling mill become increasingly important factors in the cost of the strip.

An additional approach proposed to permit more economical rolling of thin strip was to roll a plurality of strips simultaneously one upon the other. In this approach, however, mechanical restraints were required to keep the strips aligned during rolling. For example, the strips were enclosed in a casing or some mechanical alignment feature was added to the mill. Also, it was generally necessary to provide some means for preventing the strips from welding together during the rolling. Often, layers of inert material were interposed between the strips or, adherent oxide layers were formed on the surfaces such as in alloys containing chromium.

In certain instances, the above discussed plural strip rolling was more economical than single strip rolling. However, much of the time, the procedures or devices required to maintain alignment and prevent welding were such as to eliminate any possible economic advantages.

BRIEF DESCRIPTION OF THE INVENTION

The subject invention provides a method and apparatus for rolling plural strips simultaneously in a manner which overcomes the above discussed problems. By use of the invention, the greater composite thickness of the plural strips at each stage of rolling allows use of larger diameter rolls and, therefore, simpler roll supporting structure and mill controls. Moreover, the roll gap does not have to be controlled to the same level of absolute precision to achieve a given level of relative precision. These advantages are achieved without the disadvantages present in prior plural strip rolling techniques.

According to one aspect, the invention contemplates a method of forming metal foil or the like comprising the steps of:

a. providing a plurality of metal strips;

b. bonding the strips together in juxtaposed relationship with a thin layer of matrix material which substantially completely covers the opposed faces of said strips to form a composite comprising alternate layers of metal strip and matrix material;

c. rolling the composite to reduce the strips the desired amount; and, d. destroying the bond between the strips following the rolling and thereafter separating the strips.

Preferably, and in accordance with a more limited aspect of the invention, the matrix material is selected to have a melting point lower than the strips and to be relatively mutually insoluble with the strips when at its melting point. Also, the matrix material can have a low shear strength but must preferably be ductile for reasons which will subsequently be discussed.

An additional aspect of the invention is concerned with a particular arrangement of the composite in that the metal strips are of differing strengths or ductility with the strongest or least ductile being positioned between at least two weaker or more ductile strips. Preferably, the weaker or more ductile strips are placed symmetrically about the stronger strip or strips. This arrangement permits rolling of relatively low ductility metals. The reason for this will be explained more fully in the detailed description of the preferred embodiments.

The subject invention provides distinct improvements over prior plural strip rolling methods in that a very thin matrix layer separates and prevents welding of the strips to one another while simultaneously forming the strips into a coherent assembly which can be handled as a unit during rolling and associated operations. Additionally, there is no need to enclose the strips in a housing or to provide special strip guide structure for the rolling mill.

An additional aspect of the invention concerns apparatus particularly suited for carrying out the above-described methods. In particular, the proposed apparatus contemplates supply means for supplying a plurality of thin metal strips for movement along a path in adjacent, spaced apart relationship. Each of the strips has relatively wide faces joined by spaced edges. Guide means are provided along the path for bringing the faces of adjacent strips into opposed alignment and substantially into contact. Between the supply means and the guide means are coating means for substantially covering at least one face of each pair of opposed faces with a bonding material. Additionally, means are provided for bringing the coated strips into contact to produce a bond between adjacent strips. Depending upon the particular type of bonding material used, means are provided for cooling the composite strips and coiling them for subsequent use or, alternately, the strips are passed directly to a rolling mill for the required reduction in cross-section.

The bonding material used will depend to a large extent upon the strip material used. In the preferred embodiment, a solder is used and the coating operation is carried out in a high temperature environment. Also, it is to be understood that surface preparation and other known steps preparatory to bonding may be required. Similarly, the surface preparation and bonding may have to be carried out in a protective atmosphere.

Accordingly, the primary object of the invention is the provision of an improved method and apparatus for rolling plural strips of metal simultaneously to produce foils.

Another object is the provision of a rolling method which allows production of thin metal foils without requiring special rolling mills or complicated controls.

A further object is the provision of a method by which metal of high strength or low ductility can be rolled into thin foils relatively easily.

A still further object is the provision of a method and apparatus of the general type described which is easy to use and requires no complicated control systems.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENTS

Figure 1:
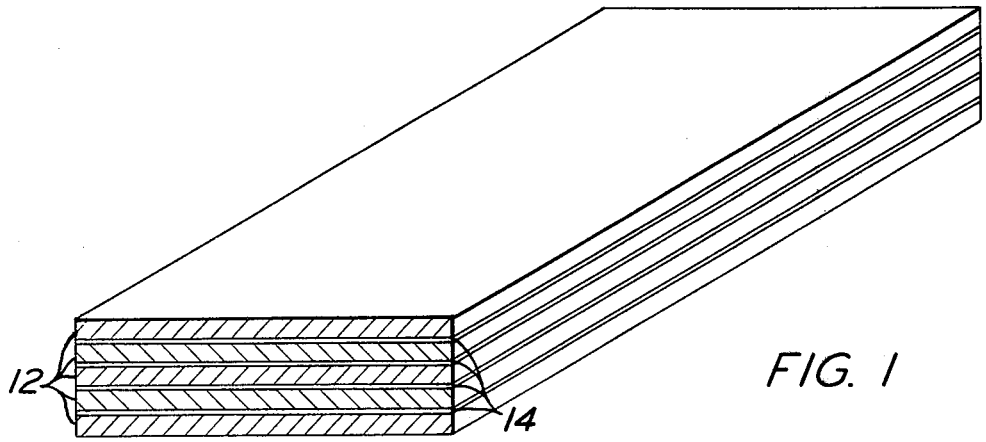
FIG. 1 is a pictorial view of a composite formed in accordance with an aspect of the subject invention and showing the composite prior to the rolling operation.

Referring more particularly to the drawings wherein the showings are for the purpose of illustrating preferred embodiments of the invention only and not for the purpose of limiting the same, FIG. 1 shows in pictorial form an assembled composite strip prior to rolling and comprising a plurality of metal strips 12 joined in juxtaposed, face-to-face relationship by extremely thin layers of a bonding matrix 14. As will become apparent hereafter, the particular number of strips 12 used can vary widely, however, in the preferred embodiment, five of the strips 12 are illustrated. The strips are bonded together by matrix material which is preferably uniformly coated completely across the opposed faces of the superposed strips 12.

As will be discussed hereafter, the strips 12 can be of many different metals (the term "metal" is used in the subject specification and claims to encompass both pure metals and alloys.) Similarly, the matrix material 14 can comprise many different materials. As will be explained subsequently, however, the matrix material should preferably have certain desirable properties.

For example, the matrix material can be selected from among those materials, both metallic and non-metallic which have the following properties:

a. The matrix material must be capable of forming a bond between the strips capable of transmitting shear loads from the strips to the matrix and from the matrix to the strips.

b. The matrix material must be such that the bond it forms can be destroyed without damaging the strip.

c. The matrix material must have sufficient strength and ductility at the rolling temperature to maintain structural integrity of the composite during the rolling operation.

d. Preferably, the major components of the matrix and the strips should be mutually insoluable at the melting point of the matrix (or at least the reaction, if any, should not have a significant deleterious effect on the properties of the foils).

The strength and ductility required of the matrix material is influenced by certain characteristics of all rolling processes. As is well known, as a strip exits from the roll gap of a rolling mill, its exit speed tends to be greater than the surface speed of the roll. This produces friction between the rolls and the strip surface which tends to oppose the motion of the strip surface. Thus, there is created a tendency for the central portion of the strip to move relative to the surface at the exit of the strip from the roll gap. Consequently, if the central portion of the composite were not restrained, it would tend to move relative to the outer strips. However, if the matrix were as strong as the strips, the composite would behave as a homogeneous material.

In instances where the matrix is weaker than the strips, but ductile, a different situation arises. To explain, it should be noted that as the leading edge of the composite emerges from the roll bite, the central part of the composite elongates more than the surface layers. This, of course, produces shear in the matrix layers. Forces equal to the shear strength of the matrix multiplied by the area of bonding between the strips and the matrix are transferred from one strip to the next through the matrix in a direction to oppose the motion between the strips. As the rolling continues, increasing area is loaded in shear until the strips are stressed to their flow strength and relative motion between the strips is prevented.

As can be appreciated, during the rolling operation, the matrix undergoes two different modes of deformation. In the roll gap, large strains occur in the matrix at very high strain rates in the presence of high stresses normal to the strain direction. Outside the roll gap however, the matrix is subjected to only small strains at lower strain rates.

As becomes apparent, the matrix can have relatively low shear strength provided it possesses ductility, these qualities being measured in the absence of the forces exerted by the rolls on the material within the roll gap. Further, the matrix must be capable of deforming without rupture as the rolling occurs.

Combinations of matrix and strip material which are particularly suitable for the subject invention include:

a. all-metallic combinations such as strips of iron with a matrix of dilute alloys of zinc or tin and lead (example, 0.6 percent zinc—99.4 percent lead) or b. strips of iron or aluminum with a matrix of nonmetallic material having the properties listed above. Some crystalline polymers, for example, are believed to have the necessary properties for the matrix in those situations wherein the rolling temperatures are comparatively low.

Preferably, the matrix layers should have the minimum thickness possible. This minimizes the amount of matrix material consumed in the process and, moreover, in situations where the matrix is weaker than the strip material (this is the usual situation), the matrix layer should be kept thin for reasons to be discussed subsequently.

Assuming that the matrix is softer than the strip material, the matrix tends to be extruded from the composite in the regions adjacent to the edges and the ends. As can be appreciated, the distance in from the edge from which the matrix will be extruded is proportional to the thickness of the matrix layer. Since the total thickness of the composite across its width should be constant after the rolling operation, in those locations where the matrix has been extruded, the strips will be thicker. As a consequence, certain aspects of the invention contemplate trimming the edges to allow those regions to be discarded because of thickness variations. When the matrix layer is in the range of a few thousandths of an inch or less in thickness, the region of strip which will be discarded will be within the range normally removed in a conventional edge trim. In regions inward from the edge more than a few times the matrix layer thickness, the matrix and strips will be reduced proportionally during the rolling operation.

During rolling of the composite, the matrix may rupture in the area of the leading end. This results in separation of the individual strips forming the composite. To overcome this problem, the lead end of the composite can be reinforced by welding, mechanical means, or the like.

Typically, the minimum average thickness of the matrix layers is determined by the flatness of the strips as the composite is formed (ideally, the matrix must completely fill the gaps between the strips so that a bond is achieved) and, the minimum matrix thickness which will prevent welding of the strips during the rolling operation.

Prior to the present invention, it was known to use a non-bonded matrix between the strips. This matrix and strip assembly was then encased in a housing. With this type of approach, it was necessary to use a comparatively thick, heavy layer of matrix between each of the strips. In the subject invention, however, extremely thin layers of matrix are generally sufficient to prevent welding during rolling. As an example of how thin the matrix can be, the approach of the subject invention was used in a wire drawing operation. Seven wires were formed into a twisted strand. This created frequent point contact between the wires and, generally, the gaps between the wires were less than 0.001 of an inch. The twisted strand was then brazed with a suitable matrix alloy, which filled the interstices between the wires. Thereafter, the strand was drawn by conventional wire drawing techniques to a 99.17 percent reduction a cross-sectional area. The drawing took place at a temperature such that the wires were warm worked but the matrix was hot worked. At the drawing temperature, the matrix alloy was much softer than the wires. At the completion of the drawing operation, the matrix was dissolved in a solvent which had no effect on the wires. The wires were found to be free from welds and could be easily separated. Metallographic sections showed that the thickness of the layers of matrix alloy was at the limit of detection by optical microscopy not only at the points where contact had existed but in other regions as well. In the application of the invention to foil production, the matrix will often be much softer than the strips. The reduction in area will be extensive but in most instances, far less than the 99 percent reduction which took place in the wires. Point contact, at least infrequently, will be present in many methods of forming the composite. Thin layers of matrix with occasional point contact between strips is to be expected. Although the reasons why the subject invention can use such a thin matrix without welding is not clearly understood, it is believed to be the result of lack of relative movement between the strips. It is thought that this greatly reduces the tendency of the strips to weld, particularly at temperatures below the recrystallization temperature.

Substantially any metal could be used for the strip, provided that the basic requirements for the strip are met, namely (a) that a suitable matrix can be found to use with the strip to form the composite, (the matrix relationship to the strip has been discussed earlier), and (b) the strip must be a metal that can be rolled. While it is contemplated that both hot and cold rolling can be used, the invention is particularly suited for cold rolling. The reason for this is that if the strip is hot rolled, the tendency for the strips to weld to each other is greatly increased. As a result, for hot rolling, essentially a complete absence of contact between the strips is required to prevent welding. This greatly increases the difficulties of forming a suitable composite.

It should also be understood that strips which are themselves composites can be used. That is, individual strips can be bonded into composite strips and the resulting composite strips bonded by matrix material into a structure of composite strips. In forming the individual strips into composite strips for this purpose, however, they should be joined by bonds which will not separate when the bond between the composite strips is destroyed after the rolling operation.

The preferred thickness for the strip 12 is governed by several factors. It has been found, however, that increasing the thickness of the strip used to form the composite decreases the cost of the strip by a greater amount than the cost of the increased rolling of the composite made necessary by the increased strip thickness. If the thickness of the layers of matrix tend to be determined by the flatness of the starting strip or other factors which also tend to make the matrix layer thickness constant, then increasing the starting strip thickness will reduce the consumption of matrix material in the process. For cold rolling, the thickness of the starting strip is limited by the capacity of the strip to sustain cold work without fracture or by the excessive power requirements needed to deform the severely work hardened strip.

On the other hand, excessive thickness of the starting strip will increase the thickness of the composite and tends to increase the difficulties and expense for some handling operations. For example, greater difficulties are experienced in coiling between the formation operation and the first rolling operation, if this is done. As a general statement then, the preferred thickness is the maximum thickness possible without encountering difficulties in excessive cold work or handling operations which will offset the gains of the thicker starting strip. With regard to the general discussion of strip thickness, it should be understood that strips of varying thicknesses can be combined in a single composite so that the resulting products are foils of varying thickness.

Not only can the thickness of the strips vary but special advantages can be obtained by combining strips of more than one metal or alloy within a composite. Stronger and/or low ductility metals can be strengthened to greater strengths by the subject method than by either conventional heat treatment or cold rolling, since both strengthening processes can be combined with this invention.

Figure 2:
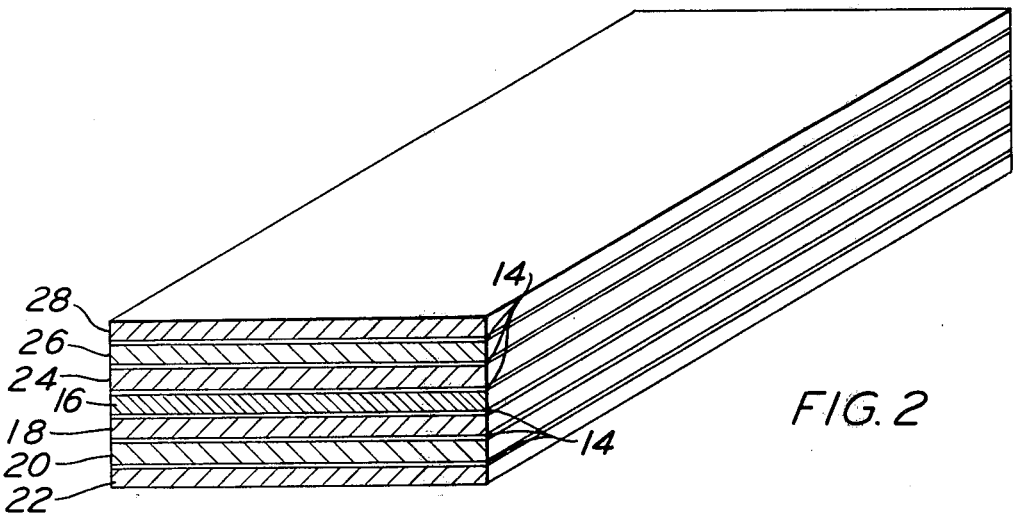
FIGS. 2 and 3 are views similar to FIG. 1 but showing modified forms of composites embodying features of the invention.

FIG. 2 shows one way in which strips of different alloys can be combined. In this embodiment, the central strip 16 is of a stronger or less ductile alloy. The outer strips 18, 20 and 22, as well as, 24, 26 and 28 are of a more ductile alloy. Additionally, in accordance with a preferred form of this embodiment, the less ductile alloy strips are positioned symmetrically about the center stronger and less ductile strip. All of the strips are bonded in face-to-face relationship with a thin layer of matrix selected as described above.

During rolling of the composite of FIG. 2, the stronger and less ductile alloy strip 16 tends to resist deformation more than the weaker and more ductile outer strips. As a consequence, this produces relative movement between the weaker outer strips and the stronger inner strip 16. Relative motion between the strips produces shear within the matrix layers and causes force to be generated within the composite which tends to prevent the relative motion in a mananer analogous to that previously explained. In the subject embodiment, however, the forces generated by shear within the matrix are opposite to those previously mentioned. The stronger center strip is thus stressed in tension while the weaker strips are stressed in compression at the exit from the gap of the rolling mill. It is well known that the application of tension to the exiting strip reduces the separating force on the rolls and permits stronger alloys to be deformed at a given set of rolling conditions (roll separation force, roll diameter, etc.). Tuus, by enclosing the relatively hard, strong and low ductility strip 16 within the ductile outer strips, it is possible to roll into thin foils alloys which could previously be rolled only with great difficulty.

Figure 3:
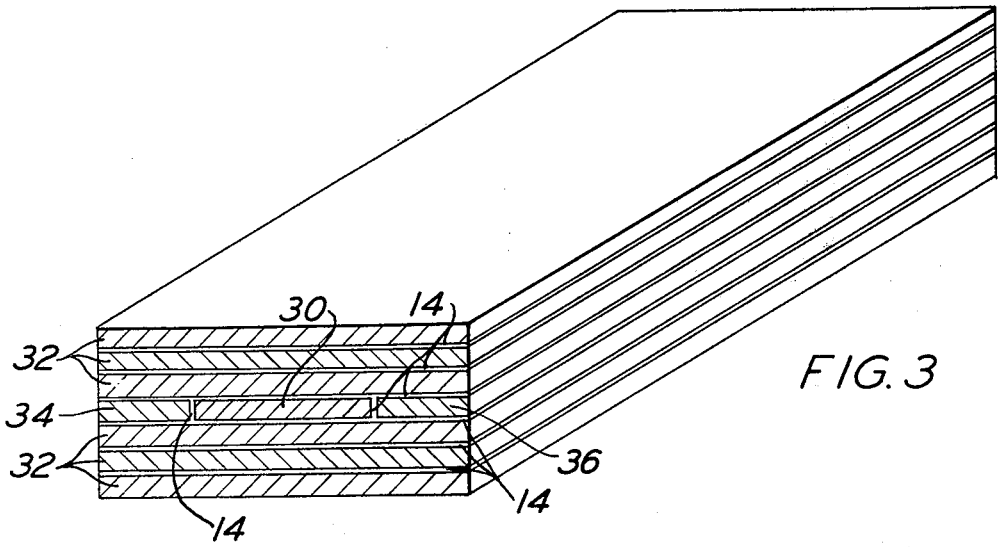

It is known that the tendency for cracks to form during rolling of a strip is greatest at the edge of the strip. FIG. 3 shows a method which counteracts the tendency to crack. In the FIG. 3 embodiment, a relatively non-ductile strong alloy strip 30 is located centrally between a plurality of more ductile strips 32. The entire composite of strips 30, 32 is bonded together with matrix material as described with reference to the FIG. 1 embodiment. Additionally, highly ductile strips 34, 36 are positioned along the lateral edges of the central strip 30 and bonded thereto. The width of the strips 34, 36 is preferably at least as great as the thickness of the resulting composite or, better still, several times as great as the composite thickness. Thus, in this embodiment, the tendency for the edges to crack is counteracted by the presence of the more ductile alloy strips 34, 36 in the position of greatest tendency to crack.

As should be appreciated, the number of outer ductile layers can be greater or less than that shown. The greater the cross-sectional area of the ductile outer strips relative to the cross-sectional area of the stronger or less ductile metal inner strip, the greater is the ability to roll the inner strip. It should be appreciated that the ductile outer strips themselves can be a useful product and need not be scrapped.

To further explain the advantages of the subject invention, music wire, a carbon-steel wire, is known to possess a valuable combination of high strength with toughness. The processing of the music wire combines a heat treatment with subsequent cold work to achieve the desired properties. Similar types of processing can be applied to strip by this invention, especially when using the more preferred method as shown and described with reference to FIG. 3.

Within limits, increasing the number of strips in the composite increases the advantages of the invention. That is, a given gauge foil can be produced with simpler rolling mills. Productivity increases directly with the number of strips. However, increasing the number of strips also increases the complexity and cost of the equipment needed to form the composite and to separate the composite after the rolling operation.

Figure 4:
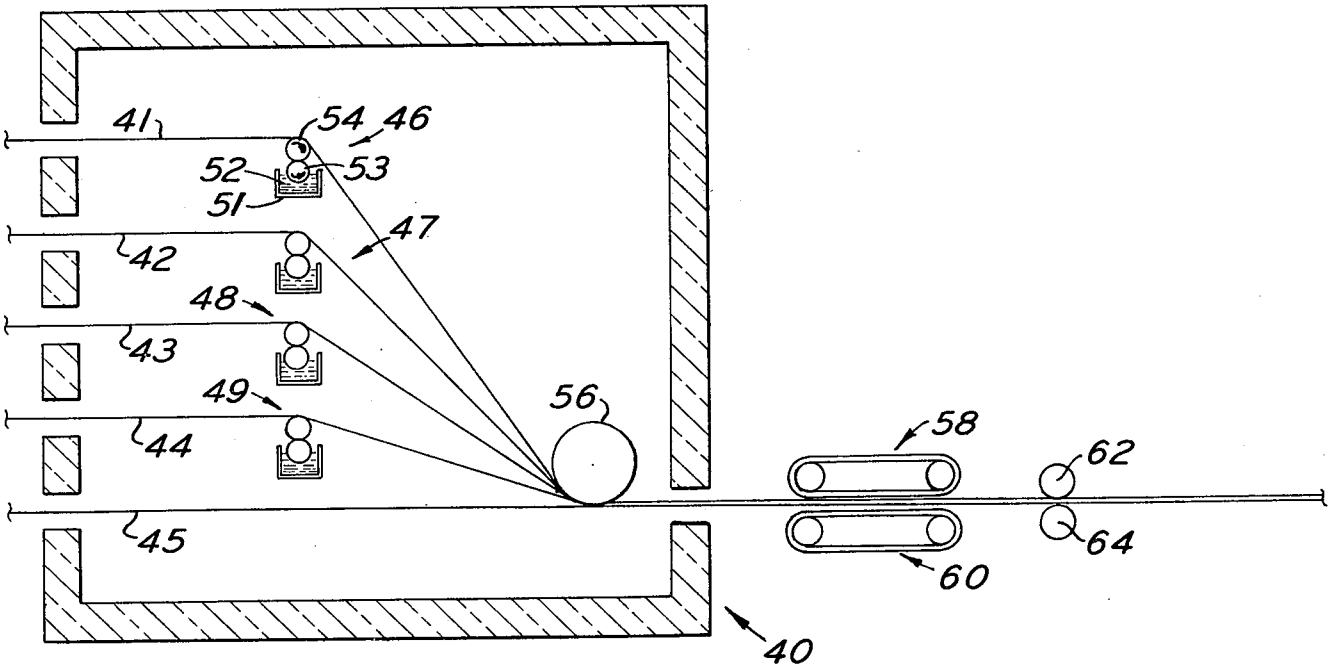
FIG. 4 is a somewhat schematic drawing showing the preferred form of apparatus for forming the composites and, FIG. 5 is a schematic drawing showing the preferred form of apparatus used for separating the rolled composites into foils following a rolling operation.
Figure 5:
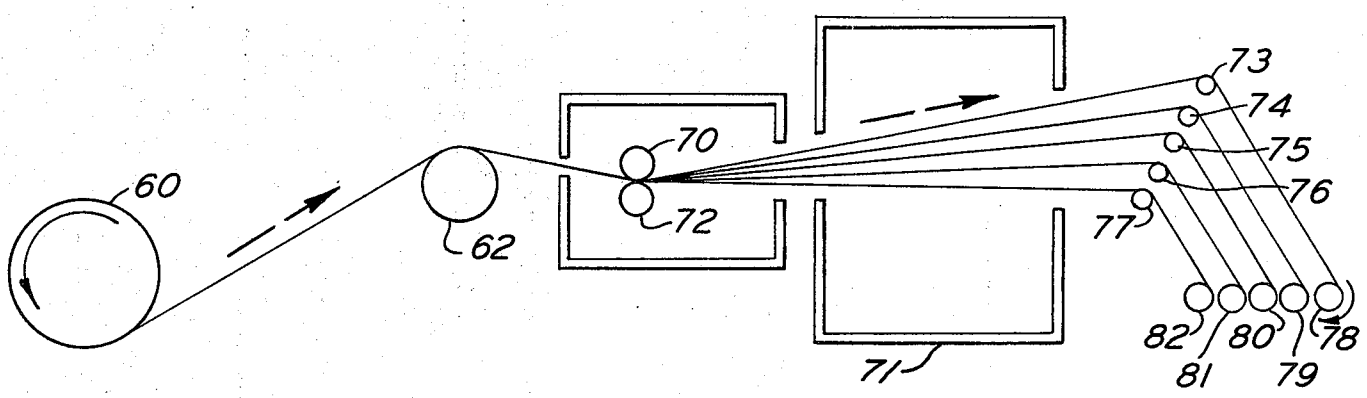

FIGS. 4 and 5 show, in diagrammatic form, apparatus capable of carrying out the invention. In particular, FIG. 4 shows a furnace 40 to which is supplied a plurality of separate metal strips 41 thru 45 which have previously been cleaned and prepared for bonding with the matrix. Strips 41 thru 45 can be supplied from any suitable type of reels or the like (not shown). Furnace 40, having an atmosphere compatible with the matrix and strip material, is maintained at a temperature sufficient to assure that the matrix material used will be at its melting point. The strips are suitably guided through the furnace 40 and pass over coating assemblies 46 thru 49. Each of the coating assemblies is designed to cover the under-surface of each of the strips 41 thru 44 with a thin, uniform layer of molten matrix material. Many different types of coating assemblies could be used; however, in the subject embodiment, each of the assemblies shown includes a suitable hopper or the like 51 arranged to hold a quantity of the matrix material 52. Rotatively mounted in each of the hoppers 51 at a level such that a major portion of its circumference is beneath the level of matrix material is a roller 53. A second roller 54 is mounted directly above roller 53 and substantially in contact there with. As the strip passes over roller 54 the rollers are driven in the direction indicated by the arrows causing matrix material to be transferred to the surface of the associated strip. As can be appreciated, by coating only the undersurfaces of the top four strips the entire assembly of strips 41 thru 45 will be bonded together as they pass under the main roll 56 in the manner shown. After passing under roll 56 the assembly of five individual strips is guided from furnace 40 and passes between conventional caterpillar type coolers 58 and 60 which quench the strips and complete the bonding process. Suitable pinch type withdrawal rolls 62 and 64 function to draw the strips and resulting composite through the furnace 40.

After passing through the pinch rolls 62, 64 the composite strip assembly can be passed directly through a roll mill stand or, alternately, can be coiled and stored for subsequent rolling as required.

Following the rolling operation, the thickness of the individual strips forming the composite have been greatly reduced in thickness. The reduced thickness composite must then be separated. FIG. 5 illustrates a typical structure for separating the individual strips. Upon start-up of the separation operation the lead end of the composite must be generally be separated manually. After the bond is destroyed at the end portion of the composite the individual foils are picked apart carefully. Alternately, in the case of ferromagnetic materials the ends of the foil strips can be caused to fan apart magnetically. As shown, the rolled composite is coiled on a reel and fed therefrom over a first guide roll 62 to a pair of pinch rolls 70; 72. Rolls 70, 72 are mounted in a heated environment having a temperature sufficient to cause melting of the matrix bonding material. As the foils pass between rolls 70, 72 they are separated and pass through a cooling chamber 71 and, thereafter, over individual guide rolls 73 thru 77 to pick up reels 78 thru 82. Depending upon the particular matrix material used it may be desirable to remove the matrix material from the separated foils. This could be accomplished in many different ways depending upon the matrix material.

The invention has been described in great detail sufficient to enable one of ordinary skill in the art to make and use the same. Obviously modifications and alterations of the preferred embodiment will occur to others upon a reading and understanding of the invention and it is my intention to include all such modifications and alterations as part of my invention in so far as they come within the scope of the appended claims.

I claim:

1. A method of forming metal foil of a predetermined thickness t and comprising the steps of:

a. providing at least three elongated strips of said metal having a thickness T which is substantially greater than t with at least one strip being substantially less ductile than at least two other strips;

b. forming at least three sheets of said metal into a composite with at least one strip constituting an inner portion of said composite with the inner portion of said composite being substantially less ductile than the outer strips, said strips being bsnded together in face-to-face juxtaposed relationship with a layer of matrix material of a thickness substantially less than T, said matrix material being applied uniformly substantially completely across said faces to form a composite comprised of alternate layers of matrix and individual metal strips;

c. rolling said composite to reduce its thickness to a point wherein said metal strips have been reduced to a thickness *t;* and, d. thereafter, destroying the bonds formed by said matrix material and separating said strips.

2. The method as defined in claim 1 wherein the central portion is substantially stronger than the outer strips.

3. The method as defined in claim 2 wherein said central portion is narrower than the outer strip.

4. A method of forming metal foil of a thickness t comprising the steps of:

a. providing a plurality of strips of said metal of a thickness T which is substantially greater than *t;* b. bonding said strips in face-to-face juxtaposed relationship with thin layers of matrix material interposed between adjacent strips and distributed uniformly across their faces to form a composite of alternate layers of strips and matrix, said matrix material being ductile and capable of transmitting shear loads between said strips, the central portion of said composite including three parallel strips, the three parallel strips being joined edge-to-edge by said matrix material, wherein the middle strip of said three parallel strips is formed from a metal having lower ductility than the remaining strips forming said composite;

c. rolling said composite to reduce its thickness to a point wherein said strips have a thickness *t;* and d. destroying the bonds formed by said matrix material and separating said strips.

5. The method as defined in claim 4 wherein the central portion of said composite is formed from at least one metal strip having a greater strength than the metal forming the remainder of said composite.

* * * * *